US007975580B2

(12) United States Patent
Haar

(10) Patent No.: US 7,975,580 B2
(45) Date of Patent: Jul. 12, 2011

(54) METHOD FOR OPERATING A PLATE SYSTEM FOR STAMPING PRESSES AND CONNECTION ELEMENT FOR CARRYING OUT SAID METHOD

(75) Inventor: Stefan Haar, Pinneberg (DE)

(73) Assignee: Saeta GmbH & Co. KG, Wedel (DE)

( * ) Notice: Subject to any disclaimer, the term of this patent is extended or adjusted under 35 U.S.C. 154(b) by 0 days.

(21) Appl. No.: 12/190,971

(22) Filed: Aug. 13, 2008

(65) Prior Publication Data

US 2009/0031874 A1 Feb. 5, 2009

Related U.S. Application Data

(62) Division of application No. 10/502,311, filed on Jan. 12, 2005, now abandoned.

(51) Int. Cl.
*B21D 43/11* (2006.01)

(52) U.S. Cl. ..... 83/30; 73/277; 73/278; 269/21; 269/54.1

(58) Field of Classification Search ..... 83/30, 451, 83/35, 36, 50, 206, 228, 257, 276–281; 269/21, 269/53, 54.1, 54.4; 14/627, 737, 752.1; 414/627, 414/737, 752.1

See application file for complete search history.

(56) References Cited

U.S. PATENT DOCUMENTS

| | | | | |
|---|---|---|---|---|
| 3,830,121 | A * | 8/1974 | Makeev et al. | 83/81 |
| 4,162,641 | A | 7/1979 | Stubbings | |
| 4,297,927 | A | 11/1981 | Kuroda | |
| RE31,053 | E * | 10/1982 | Firtion et al. | 355/77 |
| 4,357,006 | A * | 11/1982 | Hayes | 269/21 |
| 4,436,007 | A | 3/1984 | Russon et al. | |
| 4,603,611 | A | 8/1986 | Ferguson | |
| 4,685,363 | A * | 8/1987 | Gerber | 83/22 |
| 4,691,817 | A | 9/1987 | Haar | |
| 5,067,695 | A * | 11/1991 | Huddleston | 269/21 |
| 5,400,652 | A * | 3/1995 | Haar | 83/206 |
| 5,906,363 | A * | 5/1999 | Reis et al. | 269/21 |
| 6,876,897 | B2 * | 4/2005 | Gillen et al. | 700/114 |

FOREIGN PATENT DOCUMENTS

| | | |
|---|---|---|
| DE | 3841683 | 11/1989 |
| EP | 0242588 | 10/1987 |
| EP | 0539669 | 5/1993 |
| EP | 0582093 | 2/1994 |
| EP | 0616860 | 11/1996 |

* cited by examiner

*Primary Examiner* — Edward Landrum
(74) *Attorney, Agent, or Firm* — Hiscock & Barclay, LLP

(57) ABSTRACT

A method for the operation of a panel placement system for punching presses wherein a feed slide is moved between the punching die of the punching press and a transfer position located in front of the punching press. A first connection mechanism of the feed slide, in the transfer position, seizes a panel in the rear area to advance it stepwise through the punching press in response to the cycle of said punching press, wherein the panel is gripped exclusively from above in a rear edge area which is located between the rear edge and the surfaces to be punched out.

10 Claims, 3 Drawing Sheets

METHOD FOR OPERATING A PLATE SYSTEM FOR STAMPING PRESSES AND CONNECTION ELEMENT FOR CARRYING OUT SAID METHOD

CROSS REFERENCE TO RELATED APPLICATIONS

The subject application is a divisional patent application based upon U.S. patent application Ser. No. 10/502,311 which claims priority to International Patent Application No. PCT/EP2002/014753, filed Dec. 14, 2002 and German Patent Application No. 102 02 994.6, filed Jan. 26, 2002, the entire contents of each are incorporated herein by reference.

FIELD OF THE INVENTION

The invention relates to a method for the operation of a panel placement system for punching presses.

BACKGROUND OF THE INVENTION

Panel placement systems serve for delivering positioned panels, e.g. made of aluminum, to a punching press which punches out a predetermined number of blanks from the panel. EP 0 539 669 has made known a panel placement system in which the first gripping means seizes a panel on opposed sides at a transfer position. The panel is moved to the transfer position by second gripping means which engage the rear edge of the panel. The transfer position corresponds to a position of the panel in which the punch performs a first punching stroke on the panel. The feed slide having the second gripping means brings the panel to the transfer position only after the first gripping means have reached their pick-up position along the two axes. The first gripping means are adjustable along two orthogonal axes to allow an offset pitch to be chosen for the surfaces to be punched out, for a favorable material utilization. As was mentioned the transfer of the panel to the first gripping means at the transfer position takes place during the first punching step during which the panel is fixed by the punching die. After the machining of the preceding panel ends the two axes of the feed for the first gripping means and the feed slide travel to the initial and pick-up position in which a new panel is picked up. The panel placement system described helps to significantly reduce the transfer time for the panels with the press continuing to run. Nevertheless, there is at least one idle stroke between the punching step of a preceding panel and the first punching step of the succeeding panel. The idle stroke could possibly be avoided by lowering the die ring. However, the benefit which is achievable is brought about at the expense of positioning errors as the panel is pulled down during the last cut.

During the last stroke of the known placement system, one of the two pairs of feed pliers is directly at one of the outer dies. If it is to be ensured that the upper edge of the lower gripper mouth defines a plane with the die ring to prevent the panel from being pulled down during the last stroke the pliers are in a specifically formed pocket of the lower die ring when cutting diameters are small (<100 mm). The panel which is newly to be introduced has to be passed through under the feed pliers. However, this can be accomplished only after the pliers are moved back a sufficient length to leave enough space for the panel which is moving in. The front edge of the panel which is newly to be introduced has to be raised to the level of the die ring. Even if pockets do not require to be provided in the die rings when cutting diameters are larger it is then difficult for thicker metal sheets to get through between the pliers and the die ring. The gap between the pliers and the die ring can also be released by raising the pliers. However, this procedure takes time. Also, a panel placement system is known in which the gripping pliers engage the rear panel edge. Also in this configuration, however, the gripping pliers will be at a position identical to a die ring as in the previously described system during the last stroke. A more precise look during the engagement effected on the rear edge reveals, however, that if there is a diagonal feed only the pushing pliers act during a change of row. This results in a start of acceleration only at certain points and causes a diagonal formation of waves which takes a very long time to pass through the entire panel. Not until the panel lies in a flat condition again is precise punching is possible. A dynamic operation is no longer possible from the moment at which the undulary motion begins. The problem specifically occurs at the start of panel machining when the panel still has its full size and the distance of the pliers from the die is minimal.

The punching press runs so fast as is allowed by this feed motion. Then, however, no time will be left for the panel to undergo additional handling such as lifting or carrying away. Thus, this lack of time results in a reduction of the possible number of revolutions of the press and, hence, a reduction of the performance of the entire system. This same applies to all panel feed systems which are known.

As mentioned already, the known gripping means are formed by pliers. The pliers wear rapidly, primarily when panels of chromium-plated sheet steel are employed. The chromium will crumble off the panel edges and causes debris to work into the mouths of the pliers. Wear also takes place in the joints of the pliers. Since the plier size has to be small there is a need to provide bearings of a simple construction only, which further increases wear.

When punching is done in the final row the stability of the remaining grid will usually collapse because the residual sheet metal pieces are only left suspended in webs and, therefore, are still joined to the gripping pliers only to a limited extent. This causes dimensional variations with respect to the position of the panel in the die.

SUMMARY OF THE INVENTION

It is an object of the invention to provide a method for the operation of a panel placement system for punching presses which avoids any idle stroke while having a high press speed, allowing the panel to be guided in a stable fashion, and permitting operation with nearly no wear.

The method of the present invention is achieved by the steps in which first connection means of the feed motion seize the panel exclusively from above in a rear edge area which is located between the rear edge and the surfaces to be punched out. What is understood by the surfaces to be punched out here is the final row of the surfaces to be punched out, based on the direction of feed.

The rear edge area can be seized by means of the first connection means in a variety of ways and manners. An aspect of the invention provides that the connection means seize the rear edge area via a vacuum. According to the invention, another possibility is that the connection means seize the rear edge area electromagnetically.

Seizing the rear edge area via a vacuum and/or electromagnetically causes a frictional fit between the connection means and the panel. To improve the possibility for a work drive, an aspect of the invention provides that the connection means seize the panel by means of pointed projections which penetrate into the rear edge area of the panel when the connection means seize the edge area. This establishes a positive fit between the connection means and the panel.

The projections of the first connection means can be formed by pin-like spikes which penetrate into the panel, in which the spikes can be disposed within suction ports of vacuum nozzles, according to an aspect of the invention. At the moment the panel is pressed against the nozzle a spike of the nozzle penetrates into the panel either fully or partially. Even if the steel was cold-rolled twice, the spikes can penetrate through a panel which is 0.18 mm thick, for example.

The connection means may be disposed on at least one ledge which cause portions thereof to engage gores which are defined between the rear edge of the panel and the surfaces to be punched out. For example, the ledge can present one or more suction ports which are connected to a vacuum source.

For an interengagement of the connection means and the panel, it is necessary either for the connection means to carry out a lifting motion in order to be lowered against the panel and to be moved up again subsequently in order that the panel be advanced in the plane of cut. Alternatively, it is also possible to maintain the connection means at a constant height and to raise the panel or rear end of the panel at the transfer position instead to establish the frictional fit or positive fit with the first connection means.

The inventive method uses areas of the panel which are not punched out, for the connection means. Usually, the panels in question are those which leave vacant spaces between the cuts, which mostly are of a round or non-rectangularly formed shape, and the rear edge. In the invention, those vacant surfaces are utilized for seizing and shifting the panels.

A further advantage of the invention is that a panel, while undergoing the final punching cut, is not pulled around, but the preceding panel can be pulled out rearwards instead and a fresh panel can be readily pushed in by a feed slide underneath.

The inventive method can be employed for all panel feed systems which are known. It is usable for panel placement systems which operate with a feed slide which conveys the panels from an aligning station to a transfer station in which they are seized by the connection means of the feed slide and are advanced to the punching press. The invention is also applicable to so-called four-axis systems in which the feed slides fetch the panels directly from the aligning station and advance them to the punching press. In this case, two feed slides are provided which alternately advance the seized panels to the punching press. The essential thing of all feed systems, if they use the inventive method, is that each next panel that follows is pushed into the punching press with no idle stroke and with no need to reduce the number of revolutions of the press as compared to its possible punch-out speed or to make other provisions apt to avoid a delay in time while the succeeding panel is pushed in and after the final row of openings is punched into the preceding panel.

In the inventive method, the time required to pick up and take over a panel is exceptionally short and allows to operate without any idle stroke without reducing the number of revolutions of the press.

Another advantage of the invention is that better guidance is possible because of the way the panel is seized, specifically when the panel is large and thin. While the panel is fixed according to the invention, the force can be introduced across the entire panel width and undulary motions or the like can be avoided during a dynamic operation. This makes possible considerably larger accelerations and higher performances.

Finally, this obtains the advantage that if the panel is seized according to the invention, the stability of the remaining grid is distinctly higher than in known methods. It avoids dimensional variations which can occur because of the collapse of the grid pieces which are left behind.

The invention will be described in more detail below with reference to an embodiment thereof.

DETAILED DESCRIPTION

Figure 1:
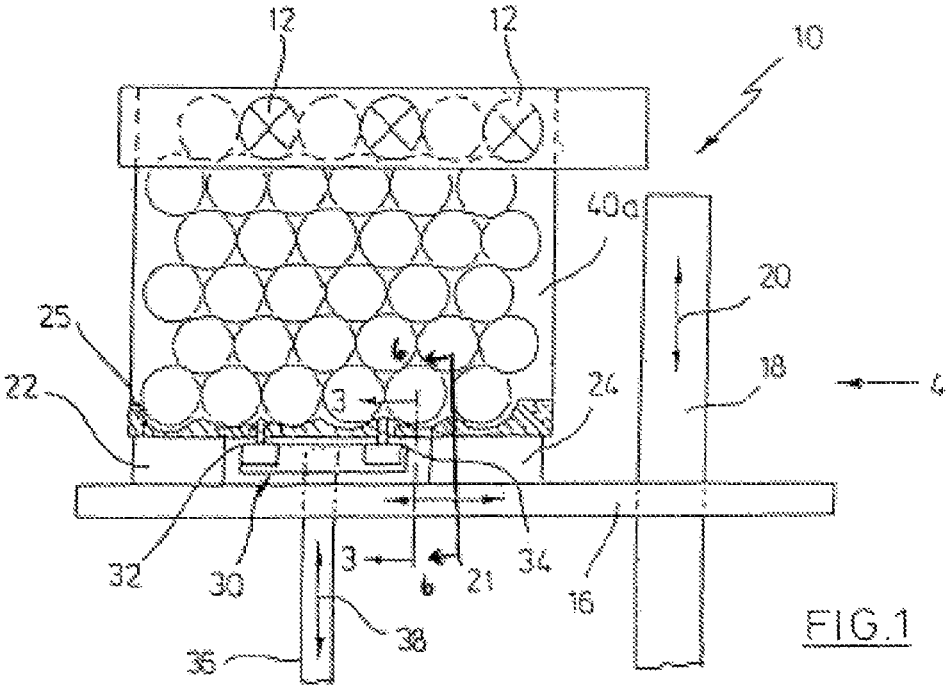
FIG. 1 shows a plan view of a schematically shown panel placement system including means of the invention during the transfer from an advancement slide to a feed device.
Figure 2:
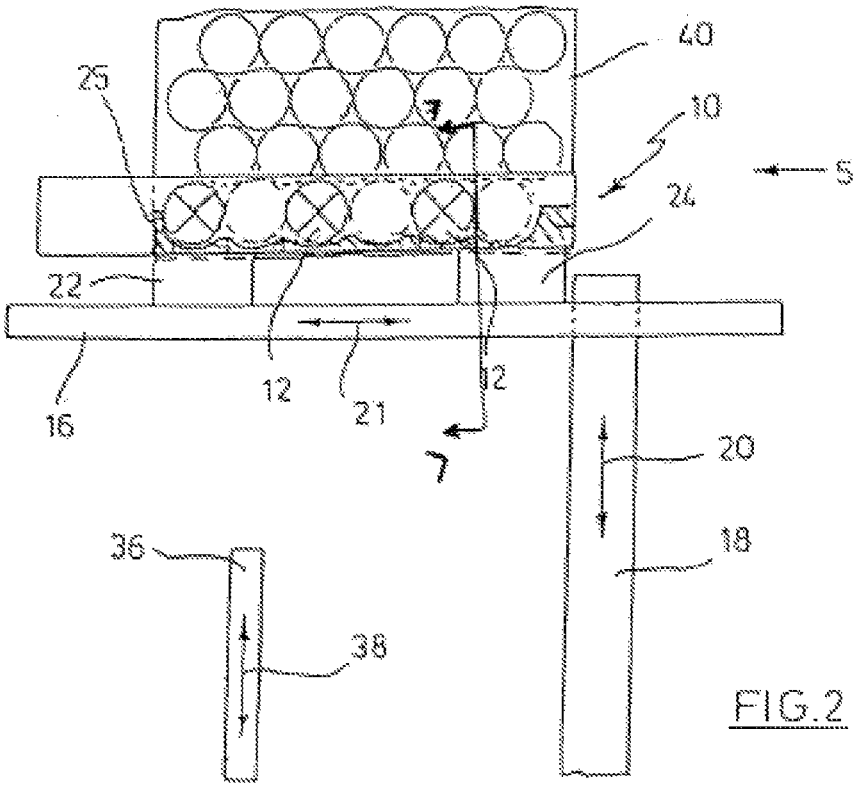
FIG. 2 shows a representation similar to FIG. 1 with a panel after the end of machining.

In FIGS. 1 and 2, a punching press of a conventional design type is designated by 10. The punching press has three punching dies 12 which are moved perpendicularly to the plane of the drawing by means of a ram. A feed slide 16 is adjustable along a guideway 18 in the direction of the two-ended arrow 20. The feed slide 16 has holders 22, 24 for a gripper ledge 25 as a first connection means. Reference to the structure of the ledges 25 will be made later. The slide 16 and the holders 22, 24 are actuated by appropriate adjustable drives which are not shown and, in turn, are controlled by a suitable control device.

An advancement slide 30 (only shown in FIG. 1) having two pairs of gripping pliers 32, 34 as second connection means is adjustable along a slide guideway 36 in the direction of the two-ended arrow 38. The drive of the slide 30 is not shown either. However, a frictional fit by the advancement slide is perceivable, e.g. by magnetic force or a vacuum.

Figure 3:
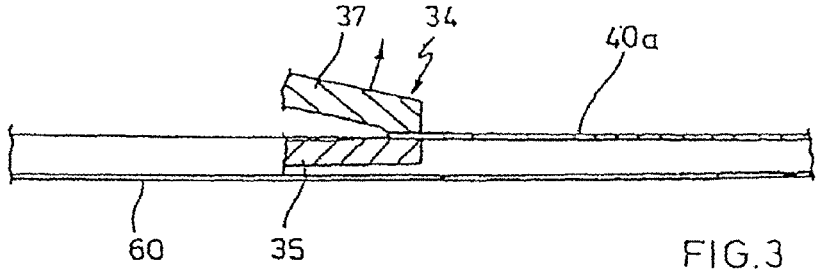
FIG. 3 shows a section taken through the representation of FIG. 1 along the line 3-3.

The gripping pliers 32, 34 can be of a conventional structure, e.g. a non-movable jaw 35 as a lower mouth and a movable jaw 37 as a upper mouth with the movable jaw 37 actuated by an appropriate drive which is not shown (see FIG. 3).

As can be recognized from FIGS. 1 and 2, the contour of the ledge is such that it engages the gores by portions which are formed between the surfaces to be punched out in the respective rear row and the rear edge. The ledge 25 is always above the panel 40*a* and 40. It is shown in cross-section in FIGS. 4-7.

Figure 4:
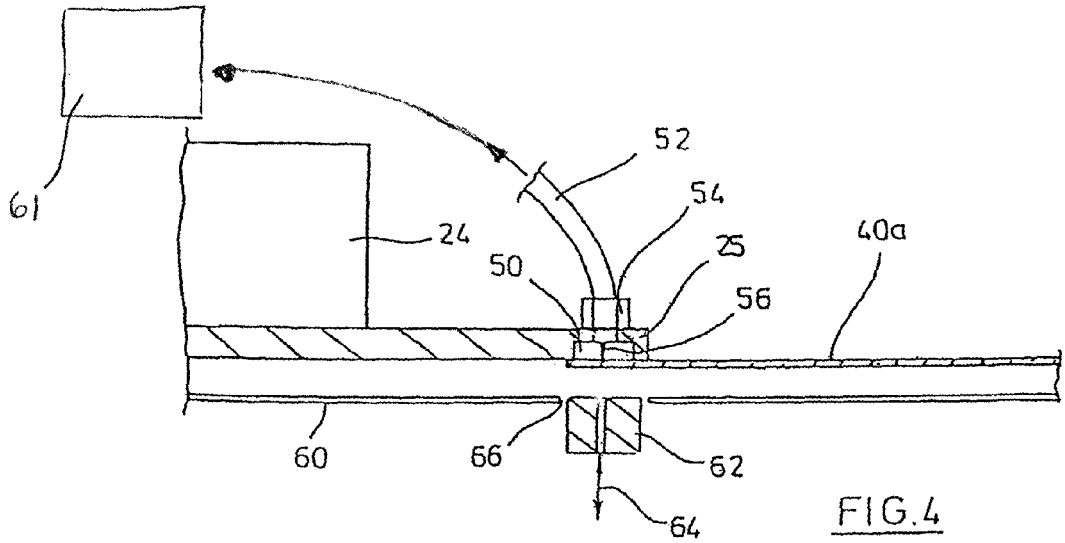
FIG. 4 shows the view taken in the direction 4 of FIG. 1.
Figure 5:
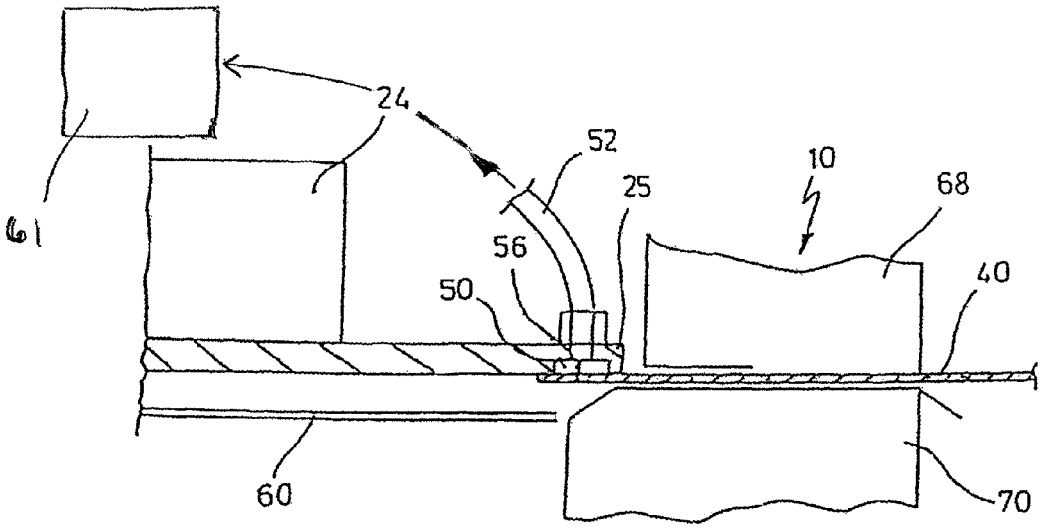
FIG. 5 shows the view taken in the direction 5 of FIG. 2.
Figure 6:
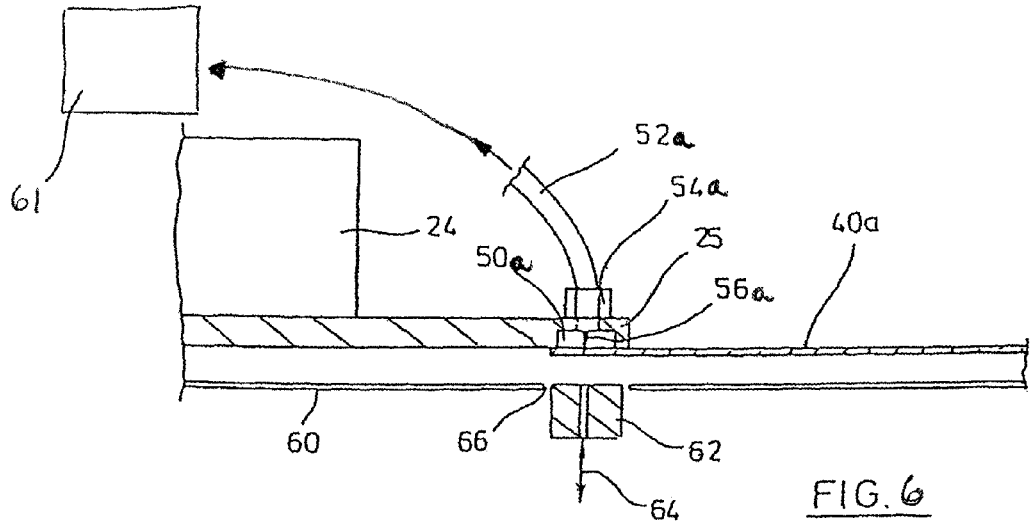
FIG. 6 is a section view taken through the line 6-6 of FIG. 1.

In FIGS. 4 and 5, at the underside of the ledge 25, a plurality of recesses 50 (only one being shown in FIGS. 4 and 5) can be seen to which a duct 52 is led via a suitable connection 54, FIG. 6. The duct 52 is connected to a vacuum source 61, FIGS. 4 and 5, so that the recess 50, is under a negative pressure. Therefore, such negative pressure helps in holding the panel 40 and 40*a* by the ledge 25.

A pin-like spike 56 is centrally disposed in the recess 50. When the panel 40 or 40*a* is held against the ledge 25, the spike will penetrate into the material of the panel 40*a* or 40 so that the panel is also held in a positive fit. In this manner, it is possible to advance the panel 40*a* or 40 to the press as desired.

Figure 7:
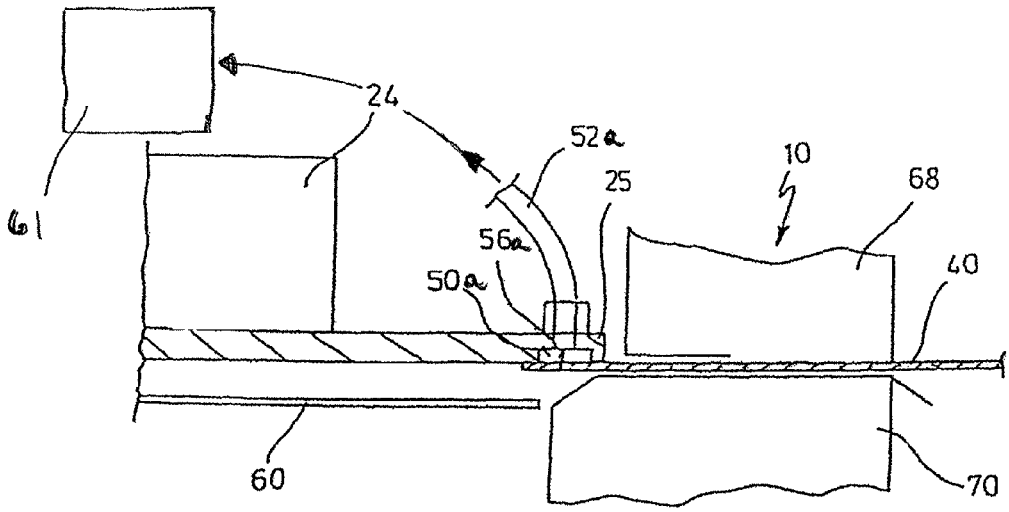
FIG. 7 is a section view taken through the line 7-7 of FIG. 2.

As shown in the sectioned views of FIGS. 6 and 7, the ledge 25 can have a plurality of such connections means; for example, including 50*a*, 52*a*, 54*a* and 56*a*, as shown in FIGS. 4 and 5, in order to seize the panel 40*a* or 40 across a large width.

Referring to FIGS. 4 and 5, it should be noted that the rear panel edge, in reality, ends much closer to the die than is shown. A measure of 1 mm is common between the edge and the cut. Accordingly, the fixation point will then be between the male dies rather than in front thereof.

FIG. 2 shows a panel 40 to be machined at a position in which the final punching step is performed. Once the punching dies 12 are in engagement with the panel 40, the ledge 25 can be brought out of engagement with the panel or the grid which has remained, e.g. by a change-over from the vacuum to compressed air. The feed slide 16 runs back to a transfer position as is shown in FIG. 1. The gripping pliers 32, 34 have seized a fresh panel already during this time. When the ledge 25 has reached its position along the transverse axis 21, the pick-up position on this axis is reached as well. Thus, while the advancement slide 30 advances the fresh panel 40*a* along the longitudinal axis 20 towards the punching press 10, the ledge 25 will move because of the return motion of the feed slide 16 and, thus, the panel 40*a* can be smoothly advanced into the press 10. The transfer position corresponds to that position in which the punching dies 12 carry out the first cut. The advancement slide 30 can smoothly advance the succeeding panel below the machined panel as results from FIGS. 4 and 5. They allow the table top 60 on which the panel is advanced to be seen. Once the panel has reached the transfer position of FIG. 4 (panel 40*a*), it is raised against the underside of the ledge 25 by means of at least one lifting plunger 62 which is actuated by a lifting drive, which is not shown, in the direction of the double-ended arrow 64 so that the spike 56 can penetrate through the panel 40*a*. The plunger 62 is extended through an opening 66 of the table top and is shifted back to the initial position immediately after the lift. Now, the feed slide 16 can advance the panel to the punching press in the manner described until the final cut is made, as shown in FIG. 5. FIG. 5 shows a male die 68 and a female die 70 of the punching dies 12. The underside of the ledge 25 exactly corresponds to the cutting plane of the dies 68, 70.

The panel can also be raised, at least across some part of its width, by raising the advancement slide.

At the moment at which the punching dies 68, 70 make cuts into the panel 40 while fixing it at the same time, the gripping pliers 32, 34 are opened and the plunger 62 lifts the panel 40*a* against the ledge 25 (FIG. 4), thus causing the transfer to take place from the advancement slide 30 to the feed slide 16.

The principle shown allows the feed of the panels to be brought about with no idle strokes of the punching press. The panels 40 and 40*a* are safely seized by the ledge 25 using the connection means shown so that deformations of the panels that are caused by the feed motions will not occur. Since the panels are seized across a wide surface within the rear edge area, the remaining grid will be stabilized also during the final punching step.

The remaining grid can be released from the ledge 25, for example, by the nozzles 50 generating a pressure surge which moves the remaining grid down.

I claim:

1. A method for operating a sheet placement system for punching presses, said method comprising the steps of:

moving a feed slide between the punching die of a punching press and a transfer position located in front of said punching press;

seizing a sheet in a rear edge area of said sheet using first connection means of said feed slide, in the transfer position;

said sheet being seized exclusively from above in the rear edge area of said sheet, said rear edge area extending between a rear edge of the sheet and the surfaces to be punched out by said punching press;

advancing said sheet stepwise through said punching press in a two dimensional plane in response to the cycle of said punching press;

wherein said first connection means initially seize the sheet prior to said advancing step in a positive fit by means of a plurality of pointed projections that pierce the sheet, said first connection means comprising a ledge having the plurality of pointed projections extending downwardly from a lower surface of said ledge through respective ducts, said first connection means further seizing the rear edge area of said sheet via a vacuum engaging said rear edge area.

2. A method as recited in claim 1, wherein said pointed projections penetrate into the rear edge area of said sheet during said seizing step.

3. A method as recited in claim 1, wherein the rear edge area of said sheet is lifted against said first connection means.

4. A method as recited in claim 1, wherein said rear edge area of said sheet is lifted by separate lifting means against said first connection means.

5. A method as recited in claim 1, wherein said ledge extends across a major width dimension of said sheet.

6. A method as recited in claim 1, wherein said first connection means carry out a lowering and lifting motion to seize the rear edge area of said sheet.

7. A method as recited in claim 1, wherein said feed slide is guided by a slide guideway, said feed slide being movable along a first axis towards said punching die and away therefrom to a pick-up position, said first connection means being guided by said feed slide and dislocated along a second axis perpendicular to said first axis, said method further including the steps of:

feeding said sheet to the transfer position using an advancement slide having second connection means, said advancement slide being dislocated along said first axis wherein said sheet is seized by said first connection means from above at the rear edge are of said sheet during a punching step of the punching press in the transfer position; and bringing a succeeding sheet into the transfer position when said first connection means have reached a take-over position between the first and second axis.

8. The method according to claim 1, including the step of separating said first connection means and a remaining grid from each other by means of a pressure surge generated through said first connection means.

9. The method according to claim 1, wherein said ledge carries gripping portions thereof to engage gores of said rear edge area pierced by said plurality of pointed projections.

10. The method according to claim 1, wherein pin-like spikes are provided as said projections.

* * * * *